US009554677B2

(12) United States Patent
Cattacin et al.

(10) Patent No.: US 9,554,677 B2
(45) Date of Patent: Jan. 31, 2017

(54) DISPENSER ASSEMBLY

(75) Inventors: Gilles Cattacin, Colmar (FR); Julien Marietta-Tondin, Marckholsheim (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 97 days.

(21) Appl. No.: 14/131,263

(22) PCT Filed: Jul. 6, 2012

(86) PCT No.: PCT/IB2012/001332

§ 371 (c)(1),
(2), (4) Date: Feb. 3, 2014

(87) PCT Pub. No.: WO2013/008074

PCT Pub. Date: Jan. 17, 2013

(65) Prior Publication Data

US 2014/0158811 A1 Jun. 12, 2014

(30) Foreign Application Priority Data

Jul. 8, 2011 (EP) ..... 11005622

(51) Int. Cl.
*B65H 16/06* (2006.01)
*A47K 10/38* (2006.01)
*B65H 19/12* (2006.01)

(52) U.S. Cl.
CPC ..... *A47K 10/3809* (2013.01); *A47K 10/38* (2013.01); *B65H 16/06* (2013.01); *B65H 19/126* (2013.01);
(Continued)

(58) Field of Classification Search
CPC .... A47K 10/38; A47K 10/3809; B65H 16/06; B65H 19/126; B65H 18/028; B65H 2301/44332; B65H 2401/213; B65H 2402/5154;B65H 2402/523; B65H 2515/71; B65H 2701/526
See application file for complete search history.

(56) References Cited

U.S. PATENT DOCUMENTS 1,577,451 A 3/1926 Delerue
1,625,190 A 4/1927 Boynton
(Continued)

FOREIGN PATENT DOCUMENTS

CN 101184421 5/2008
DE 2427519 A1 12/1975
(Continued)

OTHER PUBLICATIONS

English-language translation of a Chinese Office Action dated Aug. 12, 2015 issued in related Chinese patent application No. 201280034079.9 (10 pages).
(Continued)

*Primary Examiner* — Jeremy R Severson
(74) *Attorney, Agent, or Firm* — Drinker Biddle & Reath LLP

(57) ABSTRACT

A dispenser assembly for dispensing a sheet from a roll of sheet material having a longitudinal axis, including:

a roll holder for removably holding the roll of sheet material, which is free to rotate relative to the roll holder;

a base for supporting the roll holder and for coupling the dispenser assembly with an environment structure; and a pair of coupling elements including a first element coupled to the roll of sheet material and a second element integral to the roll holder, the first element being coupled in a free to rotate and removable manner relative to the second element by magnetic coupling. The first element includes a contacting portion extending transversally relative to the longitudinal axis, which is adhered to a lateral edge of the roll of sheet material
(Continued)

and arranged to at least partially recover the lateral edge so that the first element is fixedly secured to the roll of sheet material.

24 Claims, 3 Drawing Sheets

(52) U.S. Cl.
CPC ..... *B65H 2301/44332* (2013.01); *B65H 2401/213* (2013.01); *B65H 2402/5154* (2013.01); *B65H 2402/523* (2013.01); *B65H 2701/526* (2013.01)

(56) References Cited

U.S. PATENT DOCUMENTS

| | | | | |
|---|---|---|---|---|
| 2,555,885 | A | 6/1951 | Hope | |
| 3,022,957 | A * | 2/1962 | Blunt | A47K 10/38 211/101 |
| 4,381,083 | A * | 4/1983 | Tsunetsugu | A47K 10/38 242/422.5 |
| 4,452,403 | A | 6/1984 | Arronte | |
| 4,614,312 | A | 9/1986 | Del Pino | |
| 4,676,448 | A * | 6/1987 | Kofler | B65H 16/06 242/129.6 |
| 4,848,690 | A * | 7/1989 | Lemoine | A47K 10/38 225/51 |
| 5,249,755 | A | 10/1993 | Jespersen | |
| 5,370,339 | A | 12/1994 | Moody et al. | |
| 5,449,127 | A * | 9/1995 | Davis | A47K 10/38 242/560 |
| 5,992,459 | A * | 11/1999 | Sugita | F16K 11/0743 137/625.43 |
| 6,007,019 | A | 12/1999 | Lynch | |
| 6,145,771 | A * | 11/2000 | Santa Cruz | A47K 10/38 225/106 |
| 6,186,439 | B1 * | 2/2001 | Carey | A47K 10/38 242/596.3 |
| 6,361,229 | B1 | 3/2002 | Shinga | |
| 7,287,720 | B1 | 10/2007 | Allegre et al. | |
| 7,568,653 | B2 * | 8/2009 | Zeiron | A47K 10/38 242/596.7 |
| 2003/0106398 | A1 | 6/2003 | Tramontina et al. | |
| 2006/0261211 | A1 | 11/2006 | Hass | |
| 2012/0280078 | A1 * | 11/2012 | Lowe | A47K 10/38 242/597.1 |
| 2013/0047554 | A1 * | 2/2013 | Bertram | B65H 23/182 53/452 |
| 2013/0112802 | A1 * | 5/2013 | Griggs | A47J 47/16 242/590 |
| 2014/0158810 | A1 * | 6/2014 | Cattacin | A47K 10/38 242/596.4 |
| 2014/0158811 | A1 | 6/2014 | Cattacin et al. | |
| 2014/0266553 | A1 | 9/2014 | Chen et al. | |

FOREIGN PATENT DOCUMENTS

| | | | |
|---|---|---|---|
| DE | 3114869 | A1 | 10/1982 |
| EP | 1454579 | A1 | 9/2004 |
| EP | 1600089 | A1 | 11/2005 |
| FR | 2847790 | A1 | 6/2004 |
| JP | H07250782 | | 10/1995 |

OTHER PUBLICATIONS

English-language translation of a Chinese Office Action dated Aug. 24, 2015 issued in corresponding Chinese patent application No. 201280034080.1 (8 pages).

Chinese Decision on Grant dated May 25, 2016 along with its English-language translation issued in related Chinese patent application No. 201280034079.9 (8 pages).

* cited by examiner

DISPENSER ASSEMBLY

CROSS-REFERENCE TO PRIOR APPLICATION

This application is a §371 National Stage Application of PCT International Application No. PCT/IB2012/001332 filed on Jul. 6, 2012, which claims priority to European Patent Application No. 11005622.3 filed on Jul. 8, 2011, both of which are incorporated herein in their entirety.

TECHNICAL FIELD

An aspect disclosed relates to a dispenser assembly. Another aspect relates to a roll of sheet material adapted to be dispensed by the dispenser assembly. Such a dispenser assembly finds a particular, though non-exclusive, application in dispensing paper towel roll.

BACKGROUND

The document U.S. Pat. No. 5,449,127 describes a dispenser for rolls of sheet material including a base or housing for supporting one or more rolls of sheet material. An extension from one side of the housing includes a receiver for receiving one end of an axle/push rod. A journal is positioned on the opposite side of the housing from the receiver. The journal and receiver in turn are positioned along an axis. The axle/push rod has a first section which can be inserted into the center passageway through the roll and extend at least slightly out of the opposite side of the roll. A second section of the axle/push rod abutting the side of the roll has a diameter greater than the passageway through the roll and allows the axle/push rod to push the roll rotatably supported on the first section out of the housing. The entire length of the axle/push rod is greater than twice the length of a roll. The roll on the axle/push rod is then exposed outside the housing for dispensing of sheet material. Once the roll exposed for dispensing is expired, the axle is withdrawn from the receiver and withdrawn through the housing, with a half turn the remaining rolls drop in the housing and the axle right side up is reinserted into the next succeeding roll passageway. The axle/push rod is used to then push the next roll out to where it is positioned for dispensing.

The document U.S. Pat. No. 6,145,771 describes a dispenser for dispensing a paper or plastic product that allows a user to easily tear off one sheet of the product at a time. The dispenser includes a first magnetized member, a second magnetized member, a support bar and at least one stop device.

However, these techniques are not satisfactory because the loading operation may not be easily and/or quickly done.

SUMMARY

It is desired to propose a dispenser assembly that overcomes the above mentioned drawbacks, and in particular to improve the ease of the loading operation.

According to one aspect, there is provided a dispenser assembly for dispensing a sheet from a roll of sheet material, the roll of sheet material having a longitudinal axis, the dispenser assembly including:

a roll holder for removably holding the roll of sheet material, the roll of sheet material being free to rotate relatively to the roll holder;

a base for supporting the roll holder and for coupling the dispenser assembly with an environment structure;

a pair of coupling elements including a first element coupled to the roll of sheet material and a second element integral to the roll holder, the first element being coupled in a free to rotate and removable manner relatively to the second element by magnetic coupling;

wherein the first element includes a contacting portion extending transversally relatively to the longitudinal axis, which is adhered to a lateral edge of the roll of sheet material and arranged to at least partially recover said lateral edge so that the first element is fixedly secured to the roll of sheet material.

The first element may be in the form of a sticker that adheres to the lateral edge of the roll of sheet material by means of an adhesive layer.

The first element may be in the form of a painted area that adheres to the lateral edge of the roll of sheet material as a result of a painting process.

The second element may be a flange secured to the base through an arm, the second element including another contacting portion arranged for magnetic coupling to the contacting portion of the first element.

The roll holder may further comprise a resilient element for pressing the flange against the contacting portion of the first element.

The first element and the second element each may include a magnet, these magnets being oriented so as to provide an attractive magnetic force between the first element and the second element.

One of the pair of coupling elements may be made of a magnetic material, the other coupling element being made of a ferro-magnetic material.

One of the pair of coupling elements may be made of a plastic charged with a magnetic powder, the other coupling element being made of a plastic charged with a ferromagnetic powder.

One of the pair of coupling elements may include a magnet, the other coupling element comprising a piece of ferro-magnetic material.

The first element may be coupled to the second element through a punctual contact.

The first element may be coupled to the second element through a surface contact, each element having a contacting portion in the form of a planar surface.

The dispenser assembly may include a pair of coupling elements positioned at both end portion of the cavity of the roll of sheet material.

The roll of sheet material may be wound onto a hollow or solid core.

The roll of sheet material may be a paper towel roll.

According to another aspect, there is provided a roll of sheet material having a longitudinal axis, the roll of sheet material being provided with a coupling element including a contacting portion extending transversally relative to the longitudinal axis, which is adhered to a lateral edge of the roll of sheet material and arranged to at least partially recover said lateral edge so that the coupling element is fixedly secured to the roll of sheet material, the roll of sheet material being adapted to be dispensed by the dispenser assembly.

According to a further aspect, there is provided a coupling element for coupling to a roll of sheet material, the roll of sheet material having a longitudinal axis, wherein the coupling element includes a contacting portion extending transversally relative to the longitudinal axis, arranged to at least partially recover a lateral edge of the roll of sheet material when adhered to said lateral edge so as to fixedly secure the coupling element to the roll of sheet material, the coupling element being adapted to be coupled in a free to rotate and removable manner relatively to another element by magnetic coupling in the dispenser assembly.

The disclosed aspects enable easy and quick authorized stuffing and loading operations. This is particularly advantageous during maintenance of a dispenser assembly used in a commercial application context.

Further, the disclosed aspects prevent unauthorized stuffing action of the dispenser assembly by an unauthorized provider or operator by requiring a specific coupling mechanism between the roll holder and the roll of sheet material. Further, the element or at least a part of it associated with the roll of sheet material is arranged to disappear once the roll has been used avoiding a second use in association with another roll of sheet material. It enables the client of such a dispenser assembly to have a specific, qualitative and controlled service during the maintenance operations.

Furthermore, an old dispenser assembly may be easily and economically retrofitted with the mechanism provided herein merely by replacing the old arms with new arms supporting one of the magnetic coupling elements as described in the various embodiments provided in the following description.

Other advantages will become apparent from the hereinafter description.

BRIEF DESCRIPTION OF THE DRAWINGS

Embodiments of the present invention are illustrated by way of examples and not limited to the accompanying drawings, in which like references indicate similar elements.

DETAILED DESCRIPTION OF PREFERRED EMBODIMENTS

In the following description, the terminology "a roll of sheet material" has a large meaning encompassing, as examples, the rolls of paper towels, toilet tissues, plastic sheets or the like, metal sheets (e.g. aluminum) sheets or the like, food preservation bags, wraps, etc. . . . The sheet material may be rolled as a continuous non-perforated sheet or pre-perforated sheets. Further, the terminology "roll of sheet material" also covers either a roll of sheet material having a core, or a roll of sheet material being coreless. In particular, during the manufacturing process of the roll of sheet material, either the sheet material is wound into a cylinder onto a core (as an example a hollow cylinder made of cardboard, or a plastic mandrel, or a metallic axle, etc. . . . ), or the sheet material is wound into a cylinder on itself such as to define a central hollow cavity of substantially cylindrical shape and of variable size extending longitudinally.

The dispenser assembly may be used for residential or commercial applications for dispensing multiple of the hereinbefore mentioned sheets of material from a roll of sheet material.

The dispenser assembly may dispense the sheets of material from the roll of sheet material either manually (a user may pull the sheet of material with a hand) or motor assisted (a motor may assist in automatically dispensing the sheet of material on wish). There are numerous mechanisms to automatically dispense the sheet of material, and also to cut the sheet of material at the user requested length.

Figure 1:
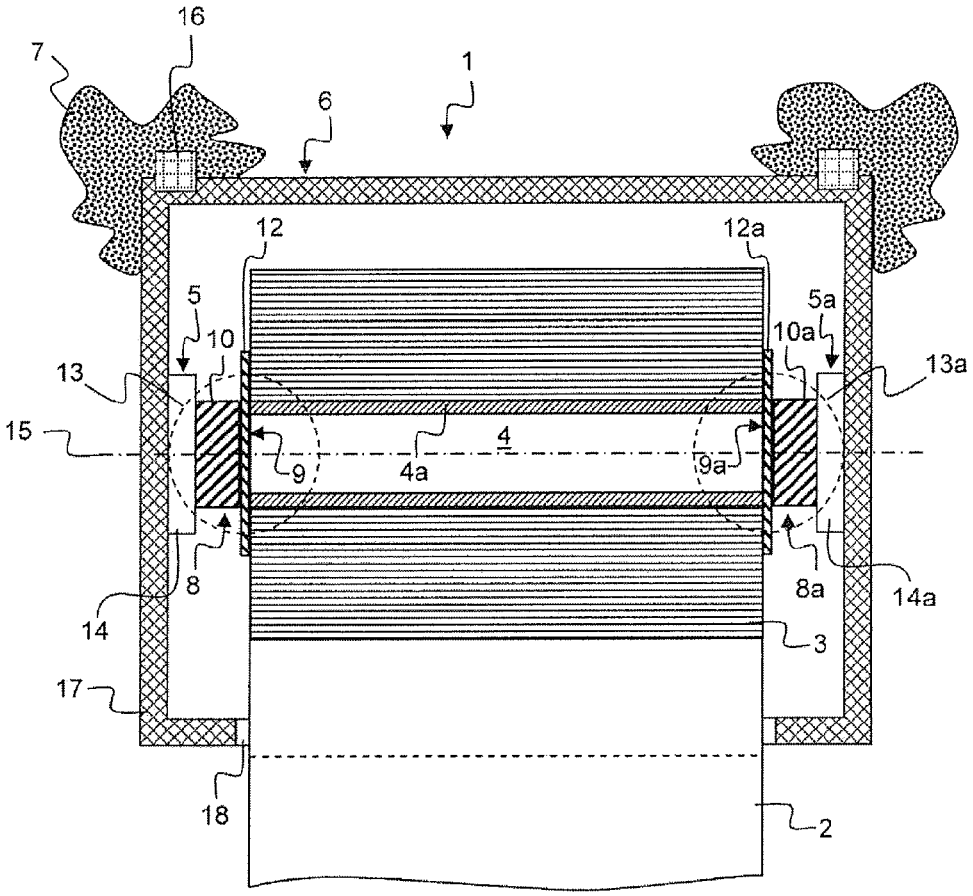
FIG. 1 is a front sectional view schematically illustrating an embodiment of a dispenser assembly.
Figure 3:
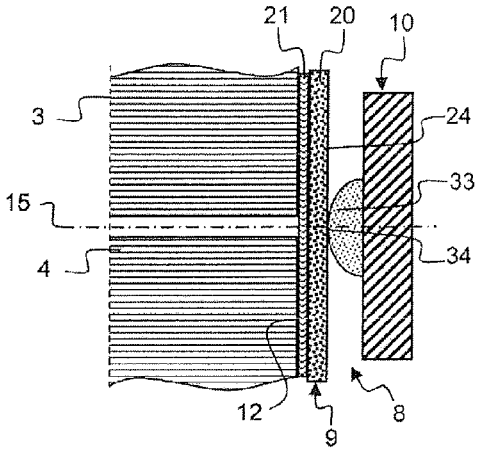
Figure 5:
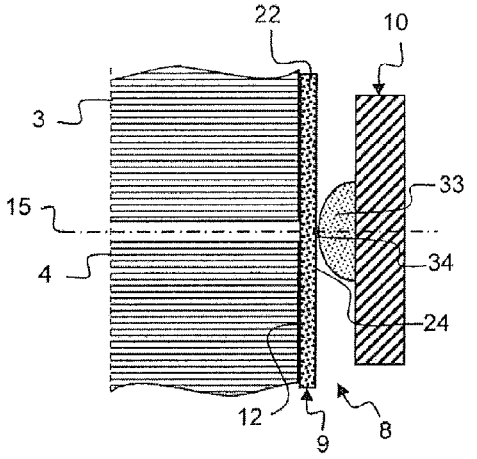

FIG. 1 schematically illustrates an embodiment of a dispenser assembly 1. In this embodiment, the dispenser assembly 1 is used to dispense a sheet 2 from a roll of sheet material 3. The roll of sheet material 3 defines a cavity 4 extending longitudinally of longitudinal axis of revolution 15. This cavity is a central hollow cylinder. In this particular example, the roll of sheet material 3 is wound onto a core 4*a*, namely a hollow cylinder made of cardboard. As depicted in FIGS. 3 and 5, the roll of sheet material 3 may alternatively be a coreless roll of sheet material. In this case, the cavity may not be finely and equally defined all along the roll length as it lacks the supporting effect of the core 4*a*. The size of the cavity, in particular the diameter of the cavity depends on the manufacturing process. It is generally adapted to the dispenser assembly as explained hereinafter.

The dispenser assembly 1 includes a roll holder 5, 5*a*, a base 6, and a pair of coupling elements 8, 8*a*. In the embodiment depicted in FIG. 1, the dispenser assembly 1 includes two roll holders 5 and 5*a* and two pairs of coupling elements 8 and 8*a*, one on each end of the roll of sheet material 3.

The roll holder 5, 5*a* holds in a removable manner the roll of sheet material 3. The roll of sheet material 3 is free to rotate relatively to the roll holder 5, 5*a*.

The base 6 supports the roll holder 5, 5*a*. The base 6 further couples the dispenser assembly 1 with an environment structure 7, for example a wall, by means of appropriate securing elements 16 (screw, glue, etc.). The base 6 may further include a housing 17 having a slit 18 that is adapted to dispense sheets 2 of material. The housing may include a hood (not shown) closed during the use of the dispenser assembly, and opened during loading or unloading operation of the roll of sheet material into the dispenser assembly.

The pair of coupling elements 8, 8*a* includes a first element 9, 9*a* coupled to the roll of sheet material 3 and a second element 10, 10*a* integral to the roll holder 5, 5*a*. The first element 9, 9*a* is coupled to the second element 10, 10*a* by a magnetic coupling in an interface zone 13, 13*a*. The magnetic coupling is such that:

the first element 9, 9*a* is free to rotate relative to the second element 10, 10*a* enabling free-rolling of the roll of sheet material 3 relative to the roll holder 5, 5*a*; and the first element 9, 9*a* is removable relative to the second element 10, 10*a* enabling engagement or disengagement of the roll of sheet material 3 with regards to the roll holder 5, 5*a*.

The first element 9, 9*a* is realized under the form of a transversally extending contacting portion (i.e., transverse to the longitudinal axis of revolution 15). The transversally extending contacting portion is adhered to a lateral edge 12, 12*a* of the roll of sheet material 3 and arranged to at least partially recover a lateral edge 12, 12*a* of the roll of sheet material 3 so that the first element 9, 9*a* is fixedly secured to the roll of sheet material 3. The terminology "adhere to" is intended to mean to stick, to become joined or to become united.

The second element 10, 10*a* may be a flange secured to the base 6 through for example an arm 14, 14*a*.

FIGS. 2 to 7 show the interface zone 13/13*a* of FIG. 1, schematically illustrating various embodiments of the pair of coupling elements 8.

These embodiments are well suited to a dispenser assembly 1 dispensing sheets 2 from a roll of sheet material 3 wound around a core 4*a* as depicted in FIGS. 2, 4, 6 and 7.

Similarly, all these embodiments are also well suited to a dispenser assembly 1 dispensing sheets 2 from a coreless roll of sheet material 3, namely a roll of sheet material 3 lacking the core 4. FIGS. 3 and 5 show two examples of such embodiments applied to a coreless roll of sheet material.

Only the pair of coupling elements referenced 8 on one end of the roll of sheet material 3 is illustrated on these FIGS. 2 to 7. The other pair of coupling elements referenced 8*a* on the other end of the roll of sheet material 3 is symmetrical and will not be further illustrated and described.

Figure 2:
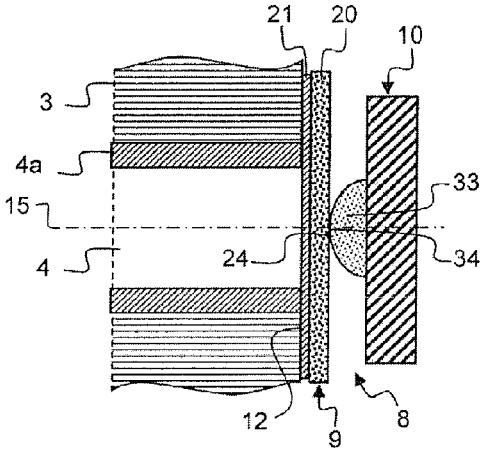
FIGS. 2 and 3 are sectional cut-away views taken of the interface zone 13/13*a* of FIG. 1 schematically illustrating a first embodiment of a pair of coupling elements of a dispenser assembly applicable to rolls of sheet material having a core and coreless rolls of sheet material, respectively.

FIGS. 2 and 3 schematically illustrate a first embodiment of a pair of coupling elements wherein the first element 9 is in the form of a sticker 20.

The sticker 20 includes the transversally extending contacting portion (i.e., transverse to the longitudinal axis of revolution 15) that is adhering to the lateral edge 12 of the roll of sheet material 3 through an adhesive/gluing/sticking layer 21. The transversally extending portion protrudes and is arranged to at least partially recover the lateral edge 12 of the roll of sheet material 3. This enables a satisfactory inter-coupling between the first element 9 and the roll of sheet material 3, in particular avoiding a loose fit between the first element 9 and the roll of sheet material.

The sticker 20 has a contacting surface 24 forming a plane. It may have various shapes, for example a circular shape, an elliptical shape, a rectangular shape, etc. . . . .

The sticker 20 is either a magnet, or a piece of ferro-magnetic material, or a plastic piece charged with a magnetic powder, or a plastic piece charged with a ferromagnetic powder. The sticker 20 is glued on each lateral edge 12, 12*a* of the roll of sheet material 3 (through the adhesive layer 21).

The sticker 20 together with the gluing layer 21 may be obtained from a sticky tape that is cut according to the desired shape.

Figure 4:
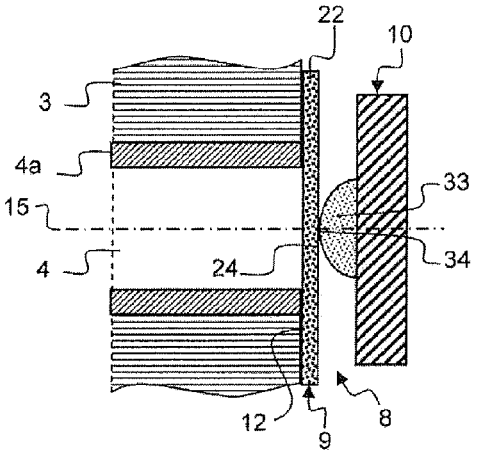
FIGS. 4 and 5 are sectional cut-away views taken of the interface zone 13/13*a* of FIG. 1 schematically illustrating a second embodiment of a pair of coupling elements of a dispenser assembly applicable to rolls of sheet material having a core and coreless rolls of sheet material, respectively.

FIGS. 4 and 5 schematically illustrate a second embodiment of a pair of coupling elements wherein the first element 9 is in the form of a painted area 22.

The painted area 22 forms the transversally extending portion (i.e., transverse to the longitudinal axis of revolution 15) that is adhering to the lateral edge 12 of the roll of sheet material 3 as a result of the painting process. The transversally extending contacting portion protrudes and is arranged to at least partially recover the lateral edge 12 of the roll of sheet material 3. This enables a satisfactory inter-coupling between the first element 9 and the roll of sheet material 3, in particular avoiding a loose fit between the first element 9 and the roll of sheet material.

The painted area 22 has a contacting surface 24 forming a plane.

The painted area 22 is a magnetic or ferro-magnetic painting (i.e. a paint charged with a magnetic or ferro-magnetic powder) that is for example painted, spray-painted or sputter-painted on each lateral edge 12, 12*a* of the roll of sheet material 3.

Various shapes of painted area 22 can be obtained, for example a circular shape, an elliptical shape, a rectangular shape, etc. . . . using as an example an appropriate stencil or pattern during the painting process.

In the hereinbefore described first and second embodiments, the second element 10 supports a magnet or a piece of ferro-magnetic material 33 having a contacting surface 34 being an elliptical surface or a spherical surface.

Thus, the first element 9 is coupled to the second element 10 through a punctual contact. This feature enables limiting the friction effect between this two elements providing a rotation of the roll of sheet material 3 relatively to the roll holder 5 even if a low pull force is exercised on the dispensed sheet 2 (shown in FIG. 1).

The magnet or the piece of ferro-magnetic material 33 is positioned facing the first element 9. When the first element 9 includes a magnet or a plastic piece charged with a magnetic powder, or a magnetic painting the second element 10 may include a magnet or a plastic piece charged with a magnetic powder, these magnetic elements being properly oriented to attract each other. Alternatively, the second element 10 may be made of a ferro-magnetic material. When the first element 9 includes a piece of ferro-magnetic material, or a ferro-magnetic painting, the second element 10 may either include a magnet, or be made of magnetic material. In all these cases, an attractive magnetic force is provided for coupling the first element 9 to the second element 10. The size and thickness of the sticker 20 or of the painted area 22 is chosen such as to provide a sufficient magnetic coupling, for example a few centimeters in size and a few millimeters in thickness.

The magnetic coupling through a punctual contact as hereinbefore described in relation with the various embodiments enables reducing the friction between the two coupling elements, thus between the roll of sheet material and the roll holder. This enables reducing the force or energy required to dispense a sheet of material either manually or motor assisted. When the dispenser assembly includes a motor (not shown) to dispense the sheet of material, having a low friction enables either to reduce electrical consumption of the motor, or to downsize the motor power for the same dispenser assembly characteristics. Further, it also reduces the motor loudness during the dispensing operation. When the dispenser assembly is manually operated (i.e. without the help of a motor), the sheet of material may be dispensed in a quasi-automatic manner by combining a very low pull force exercised on the dispensed sheet with the low friction and the effect of gravity on the currently dispensed sheet of material.

In the embodiments illustrated in FIGS. 2 to 5, the first element 9 is coupled to the second element 10 through a punctual contact, i.e. a planar contacting surface 24 (the sticker 20 or the painted area 22) against a contacting surface 34 being an elliptical surface or a spherical surface. However, the magnetic coupling between the first element 9 and the second element 10 may be implemented in other different ways.

Figure 6:
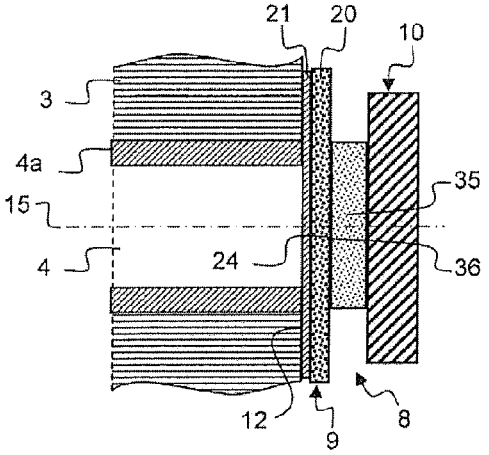
FIGS. 6 and 7 are sectional cut-away views taken of the interface zone 13/13*a* of FIG. 1 schematically illustrating other types of coupling arrangements for a dispenser assembly applicable to the first embodiment and the second embodiment, respectively.
Figure 7:
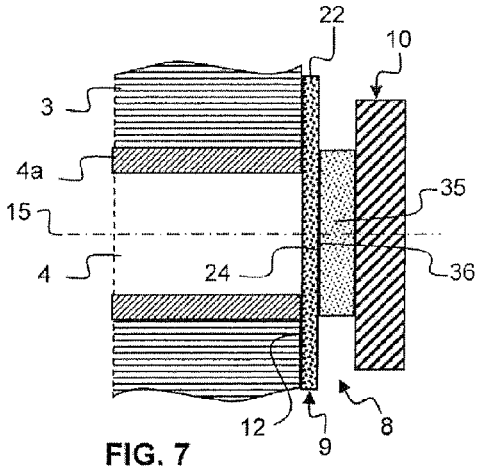

FIGS. 6 and 7 schematically illustrate other possible coupling arrangements forming a surface contact. These coupling arrangements may replace the punctual contact in the embodiments illustrated in FIGS. 2 to 5. The alternative embodiments of FIGS. 6 and 7 are based on the embodiments depicted in FIGS. 2 and 4, respectively. These embodiments differ in that the second element 10 supports a magnet or a piece of ferro-magnetic material 35 having a contacting surface 36 being a plane. The magnet or the piece of ferro-magnetic material 35 may be, for example, a cylinder or a parallelepiped. Thus, each of the first element 9 and the second element 10 has a contacting surface in the form of a planar surface.

These embodiments of the pair of coupling elements 8 are also applicable to coreless rolls of sheet material.

Figure 8:
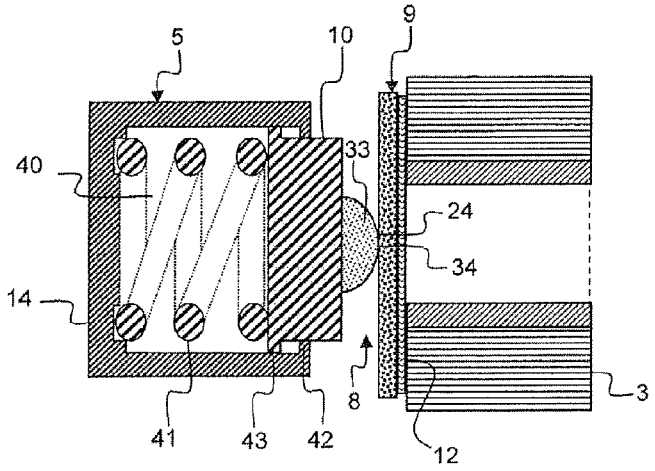
FIG. 8 is sectional cut-away view taken of the interface zone 13/13*a* of FIG. 1 schematically illustrating an example of a roll holder in a dispenser assembly.

FIG. 8 schematically illustrates an example of roll holder 5 (or 5*a*). The second element 10 is a flange secured to an arm 14. The arm 14 may include a recess 40 receiving the second element 10 and also a resilient element, for example a spring 41. The second element 10 is free to move within the recess while being pushed by the spring 41 outside the recess. An abutment 42 in the recess may cooperate with a shoulder 43 of the second element 10 to block the full translation of the second element outside the recess 40. During a loading or unloading operation of the dispenser assembly 1, the second element 10 is retracted into the recess 10 due to the pushing action of the roll of sheet material 3 being installed. Once in place, the spring 41 presses the second element 10 against the contacting surface 24 (e.g. the contacting surface 24 of the sticker 20 or the painted area 22) of the first element 9. This enables providing a satisfactory contact between the first and the second elements.

Figure 9:
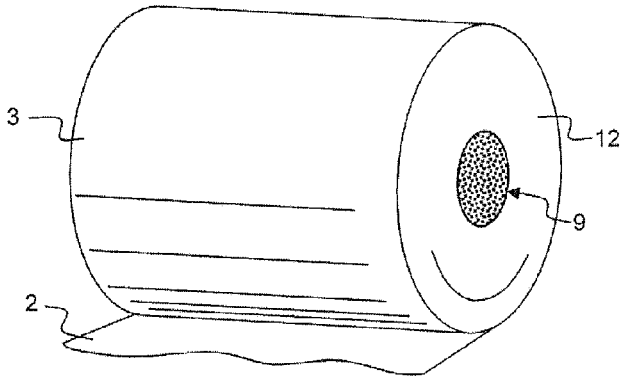
FIGS. 9 to 11 are perspective views schematically illustrating the roll of sheet material of the first embodiment (FIGS. 9 and 10) and second embodiment (FIGS. 9 and 11) at different dispensing stages.
Figure 10:
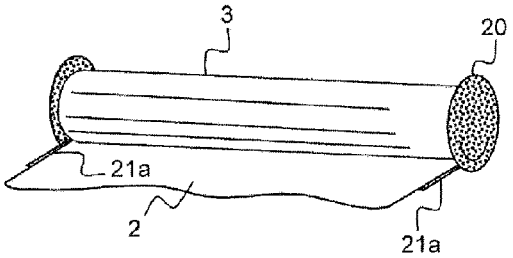
Figure 11:
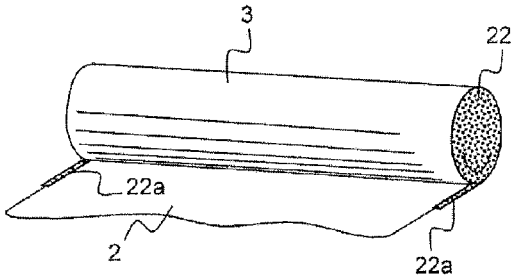

FIGS. 9 to 11 are perspective views schematically illustrating the roll of sheet material 3 of the first and second embodiments at different dispensing stages.

FIG. 9 shows the roll of sheet material 3 after the manufacturing process. A first element 9 in the form of a sticker or a painted area is adhering to the lateral edge 12 of the roll of sheet material 3.

The dispenser assembly 1 (depicted in FIG. 1) is used to dispense a sheet 2 from the roll of sheet material 3.

At a later stage, when a significant amount of sheet 2 have been dispensed from the roll of sheet material 3, further dispensed sheet portion includes a border being an adhesive band 21*a* (first embodiment) or a band of magnetic painting 22*a* (second embodiment) on each side of the sheet when the sheet 2 splits from the roll of sheet material 3. This is particularly advantageous to prevent a direct subsequent use of the first element 9. With the first embodiment, at the end of the dispensing process, the adhesive layer is lacking to further stick the sticker to another roll of sheet material 3. With the second embodiment, at the end of the dispensing process, the magnetic painted area has gradually disappeared from the lateral edge 12 of the roll of sheet material 3 with the dispensed sheet 2.

The drawings and their descriptions hereinbefore illustrate rather than limit the invention.

The depicted embodiment of dispenser assembly in FIG. 1 illustrates a particular example of a base including a closed housing with a slit. However, other kind of base, for example providing an open access to the roll of sheet material may be convenient provided that the coupling between the roll holder and the roll of sheet material is of the magnetic coupling kind as described hereinbefore.

The depicted embodiments illustrate a dispenser assembly wherein the roll of sheet material is positioned horizontally. However, it may also be positioned vertically, or at an angle.

The depicted embodiment of dispenser assembly in FIG. 1 illustrates a particular example of a dispenser assembly where the roll of sheet material is held on each edge by two pairs of coupling elements. However, it may also be held on one edge by one pair of coupling element as hereinbefore described and on the other edge by any other appropriate holding mechanism.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A dispenser assembly for dispensing a sheet from a roll of sheet material, the roll of sheet material having a longitudinal axis, the dispenser assembly comprising:

a roll holder for removably holding the roll of sheet material, the roll of sheet material being free to rotate relative to the roll holder;

a base for supporting the roll holder and for coupling the dispenser assembly with an environment structure; and a pair of coupling elements comprising a first element coupled to the roll of sheet material and a second element integral to the roll holder, the first element being coupled in a removable manner relative to the second element by magnetic coupling;

wherein the first element is coupled to the second element in a free to rotate manner, and wherein the first element comprises a contacting portion extending transversally relative to the longitudinal axis, which is adhered to a lateral edge of at least one sheet of the roll of sheet material and arranged to at least partially cover said lateral edge so that the first element is fixedly secured to the roll of sheet material.

2. The dispenser assembly of claim 1, wherein the first element is in the form of a sticker that adheres to the lateral edge of the at least one sheet of the roll of sheet material by an adhesive layer.

3. The dispenser assembly of claim 1, wherein the first element is in the form of a painted area that adheres to the lateral edge of the at least one sheet of the roll of sheet material as a result of a painting process.

4. The dispenser assembly according to claim 1, wherein the second element is a flange secured to the base through an arm, the second element comprising another contacting portion arranged for magnetic coupling to the contacting portion of the first element.

5. The dispenser assembly of claim 4, wherein the roll holder further comprises a resilient element for pressing the flange against the contacting portion of the first element.

6. The dispenser assembly according to claim 1, wherein the first element and the second element each comprises a magnet, these magnets being oriented so as to provide an attractive magnetic force between the first element and the second element.

7. The dispenser assembly according to claim 1, wherein one of the pair of coupling elements is made of a magnetic material, the other coupling element being made of a ferro-magnetic material.

8. The dispenser assembly according to claim 1, wherein one of the pair of coupling elements is made of a plastic charged with a magnetic powder, the other coupling element being made of a plastic charged with a ferromagnetic powder.

9. The dispenser assembly according to claim 1, wherein one of the pair of coupling elements comprises a magnet, the other coupling element comprising a piece of ferro-magnetic material.

10. The dispenser assembly according to claim 1, wherein the first element is coupled to the second element through a punctual contact.

11. The dispenser assembly according to claim 10, wherein the punctual contact comprises a planar surface of the first element contacting an elliptical or spherical surface of the second element.

12. The dispenser assembly according to claim 1, wherein the first element is coupled to the second element through a surface contact, each element having a contacting portion in the form of a planar surface.

13. The dispenser assembly according to claim 1, further comprises a second pair of coupling elements, wherein the second pair of coupling elements is positioned at an opposite end portion of the cavity of the roll of sheet material from the first coupling element and the second coupling element.

14. The dispenser assembly according to claim 13, wherein the second pair of coupling elements comprising a third element coupled to an opposite end of the roll of sheet material as the first coupling element and a fourth coupling element integral to the roll holder, the third element being coupled in a removable manner relative to the fourth element by magnetic coupling.

15. The dispenser assembly according to claim 1, wherein the roll of sheet material is wound onto a hollow or solid core.

16. The dispenser assembly according to claim 1, wherein the roll of sheet material is a paper towel roll.

17. The dispenser assembly according to claim 1, wherein an interface zone between the first element and the second element is external to the roll holder.

18. The dispenser assembly according to claim 1, wherein the roll holder is disposed on an interior surface of the base, and the second element is disposed on an interior surface of the roll holder.

19. A roll of sheet material having a longitudinal axis, the roll of sheet material being provided with a coupling element comprising a contacting portion extending transversally relative to the longitudinal axis, which is adhered to a lateral edge of at least one sheet of the roll of sheet material and arranged to at least partially cover said lateral edge so that the coupling element is fixedly secured to the roll of sheet material, the roll of sheet material being adapted to be dispensed by a dispenser assembly including:

a roll holder for removably holding the roll of sheet material, the roll of sheet material being free to rotate relative to the roll holder;

a base for supporting the roll holder and for coupling the dispenser assembly with an environment structure; and a pair of coupling elements comprising a first element coupled to the roll of sheet material and a second element integral to the roll holder, the first element being coupled in a removable manner relative to the second element by magnetic coupling, wherein the first element is coupled to the second element in a free to rotate manner, and wherein the first element comprises a contacting portion extending transversally relative to the longitudinal axis, which is adhered to a lateral edge of the at least one sheet of the roll of sheet material and arranged to at least partially cover said lateral edge so that the first element is fixedly secured to the roll of sheet material.

20. The roll of sheet material according to claim 19, wherein the first element is coupled to the second element through a punctual contact.

21. The roll of sheet material according to claim 20, wherein the punctual contact comprises a planar surface of the first element contacting an elliptical or spherical surface of the second element.

22. A coupling element for coupling to a roll of sheet material, the roll of sheet material having a longitudinal axis, wherein the coupling element comprises a contacting portion extending transversally relative to the longitudinal axis, arranged to at least partially cover a lateral edge of at least one sheet of the roll of sheet material when adhered to said lateral edge so as to fixedly secure the coupling element to the roll of sheet material, the coupling element being adapted to be coupled in a free to rotate and removable manner relative to another element by magnetic coupling in a dispenser assembly including:

a roll holder for removably holding the roll of sheet material, the roll of sheet material being free to rotate relative to the roll holder;

a base for supporting the roll holder and for coupling the dispenser assembly with an environment structure; and a pair of coupling elements comprising a first element coupled to the roll of sheet material and a second element integral to the roll holder, the first element being coupled in a removable manner relative to the second element by magnetic coupling, wherein the first element is coupled to the second element in a free to rotate manner, and wherein the first element comprises a contacting portion extending transversally relative to the longitudinal axis, which is adhered to a lateral edge of the at least one sheet of the roll of sheet material and arranged to at least partially cover said lateral edge so that the first element is fixedly secured to the roll of sheet material.

23. The coupling element according to claim 22, wherein the first element is coupled to the second element through a punctual contact.

24. The coupling element according to claim 23, wherein the punctual contact comprises a planar surface of the first element contacting an elliptical or spherical surface of the second element.

* * * * *